US007846882B2

(12) United States Patent
Hilker et al.

(10) Patent No.: US 7,846,882 B2
(45) Date of Patent: Dec. 7, 2010

(54) ELECTRICAL OIL FORMULATION

(75) Inventors: Andree Hilker, Hamburg (DE); Volker Klaus Null, Hamburg (DE)

(73) Assignee: Shell Oil Company, Houston, TX (US)

( * ) Notice: Subject to any disclaimer, the term of this patent is extended or adjusted under 35 U.S.C. 154(b) by 145 days.

(21) Appl. No.: 11/922,630

(22) PCT Filed: Jun. 22, 2006

(86) PCT No.: PCT/EP2006/063439

§ 371 (c)(1),
(2), (4) Date: Dec. 20, 2007

(87) PCT Pub. No.: WO2006/136594

PCT Pub. Date: Dec. 28, 2006

(65) Prior Publication Data

US 2009/0137435 A1 May 28, 2009

(30) Foreign Application Priority Data

Jun. 23, 2005 (EP) ..... 05013534

(51) Int. Cl.
*C10M 133/44* (2006.01)
*C10G 71/00* (2006.01)

(52) U.S. Cl. ..... 508/279; 208/19

(58) Field of Classification Search ..... 508/279, 508/501; 208/18, 19
See application file for complete search history.

(56) References Cited

U.S. PATENT DOCUMENTS

| | | | | |
|---|---|---|---|---|
| 3,338,877 | A | 8/1967 | Anderson | 260/88.2 |
| 4,824,601 | A | 4/1989 | Franklin | 252/401 |
| 4,943,672 | A | 7/1990 | Hamner et al. | 585/737 |
| 5,059,299 | A | 10/1991 | Cody et al. | 208/27 |
| 5,241,003 | A | 8/1993 | Degonia et al. | 525/123 |
| 5,773,391 | A | 6/1998 | Lawate et al. | 508/257 |
| 5,912,212 | A * | 6/1999 | Igarashi et al. | 508/275 |
| 6,214,776 | B1 | 4/2001 | Angelo et al. | 508/281 |
| 6,475,960 | B1 | 11/2002 | Berlowitz et al. | 508/110 |
| 6,599,864 | B1 * | 7/2003 | Bertomeu | 508/110 |
| 6,790,386 | B2 | 9/2004 | Fefer et al. | 252/570 |
| 2002/0109127 | A1 | 8/2002 | Kent et al. | 252/570 |
| 2002/0139962 | A1 | 10/2002 | Fefer et al. | 252/570 |
| 2004/0065581 | A1 | 4/2004 | Jiang et al. | 208/18 |
| 2004/0065588 | A1 | 4/2004 | Genetti et al. | 208/108 |

FOREIGN PATENT DOCUMENTS

| | | |
|---|---|---|
| EP | 582347 | 2/1994 |
| EP | 668342 | 8/1995 |
| EP | 776959 | 6/1997 |
| EP | 876446 | 11/1998 |
| EP | 1026225 | 8/2000 |
| EP | 1054052 | 11/2000 |
| EP | 1201734 | 5/2002 |
| WO | WO9201657 | 2/1992 |
| WO | WO9220759 | 11/1992 |
| WO | WO 9410264 | 5/1994 |
| WO | WO 9920720 | 4/1999 |
| WO | WO 9934917 | 7/1999 |
| WO | WO 0157166 | 8/2001 |
| WO | WO02064710 | 8/2002 |
| WO | WO02070629 | 9/2002 |

OTHER PUBLICATIONS

Sequeira. A. Jr., "Lubricant Base Oil and Wax Processing", Marcel Dekker, Inc., NY 1994, pp. 28-35. ISBN 0-8247-9256-4.
Ryland, Lloyd B., et al. Cracking Catalysts, Catalysis: vol. VII, Ed. Paul H. Emmett, Reinhold Publish Corporation, NY, 1960, pp. 5-9.
Kirk-Othmer Encyclopedia of Chemical Technology, 3rd Edition, vol. 14, pp. 477-526.
Sequeira, Jr. A.: "Lubricant base oil and wax processing", Marcel Dekker, Inc., NY 1994, ISBN 0-8247-9256-4, Chapter 9, pp. 225-245.
Klamann, D.: "Lubricants and related products", Verlag Chemie GmbH, Weinhem, 1984, pp. 330-339.

* cited by examiner

*Primary Examiner*—Walter D Griffin
*Assistant Examiner*—Frank C Campanell

(57) ABSTRACT

Electrical oil formulation comprising a base oil component and an additive, wherein (i) at least 80 wt % of the base oil component is a paraffin base oil having a paraffin content of greater than 80 wt % paraffins and a saturates content of greater than 98 wt % and comprising a series of iso-paraffins having n, n+1, n+2, n+3 and n+4 carbon atoms and wherein n is between 20 and 35; and (ii) an anti-oxidant additive; wherein the base oil component has a flash point of at least 170° C., as determined by ISO 2592.

13 Claims, 2 Drawing Sheets

ELECTRICAL OIL FORMULATION

PRIORITY CLAIM

The present application claims priority to European Patent Application 05013534.2 filed 23 Jun. 2005.

FIELD OF INVENTION

The invention is related to an electrical oil formulation comprising a base oil and an additive.

BACKGROUND OF THE INVENTION

U.S. Pat. No. 6,790,386 describes a dielectric fluid comprising an iso-paraffin base oil and additives. The iso-paraffin base oil is prepared by hydrotreating, hydroisomerisation and hydrogenation of a paraffinic vacuum feedstock.

U.S. Pat. No. 5,912,212 describes oxidative stable oil lubricating formulations consisting of a hydrocracked paraffinic mineral base oil, 3-methyl-5-yert-butyl-4-hydroxy propionic acid ester, dioctylaminomethyltolyl-triazole and dilaurylthiodipropionate. The oil had a high oxidative stability.

WO-A-02070629 describes a process to make iso-paraffinic base oils from a wax as made in a Fischer-Tropsch process. According to this publication base oils having a kinematic viscosity at 100° C. of between 2 and 9 cSt can be used as base oil in formulations such as electrical oils or transformer oils.

There is a desire to formulate electrical oils using a base oil having the properties of the Fischer-Tropsch derived base oil as described in WO-A-02070629. The main reasons are the excellent low-temperature properties of said base oils in combination with the relatively simple process to make said base oils as compared to similar oils prepared from mineral crude sources.

Electrical oil formulations require certain properties in order to be applicable for use. Typical requirements are that sludge formation should be low, oxidation stability should be high, cold flow properties should be adequate for its intended use, flash point should be adequate for its intended use and the dielectric dissipation factor should remain low, even after prolonged testing at elevated temperature. In particular for applications that require high performance at elevated temperatures and wherein elevated peak temperature in the electrical oil formulation are occurring, a very high flash point is required. At the same time, the formulation should still have good low temperature performance.

Applicants further found that formulating an electrical oil formulation starting from such a synthetic iso-paraffin base oil is not straightforward as compared to when starting from a mineral based paraffinic base oils. The object of the present invention is to provide an electrical oil formulation, which has adequate properties for its use. This object is achieved in the following oil formulation.

SUMMARY OF THE INVENTION

Electrical oil formulation comprising a base oil component and an additive, wherein (i) at least 80 wt % of the base oil component is a paraffin base oil having a paraffin content of greater than 80 wt % paraffins and a saturates content of greater than 98 wt % and comprising a series of iso-paraffins having n, n+1, n+2, n+3 and n+4 carbon atoms and wherein n is between 20 and 35; and (ii) an anti-oxidant additive;

wherein the base oil component has a flash point of at least 170° C., as determined by ISO 2592

DETAILED DESCRIPTION OF THE INVENTION

Figure 1:
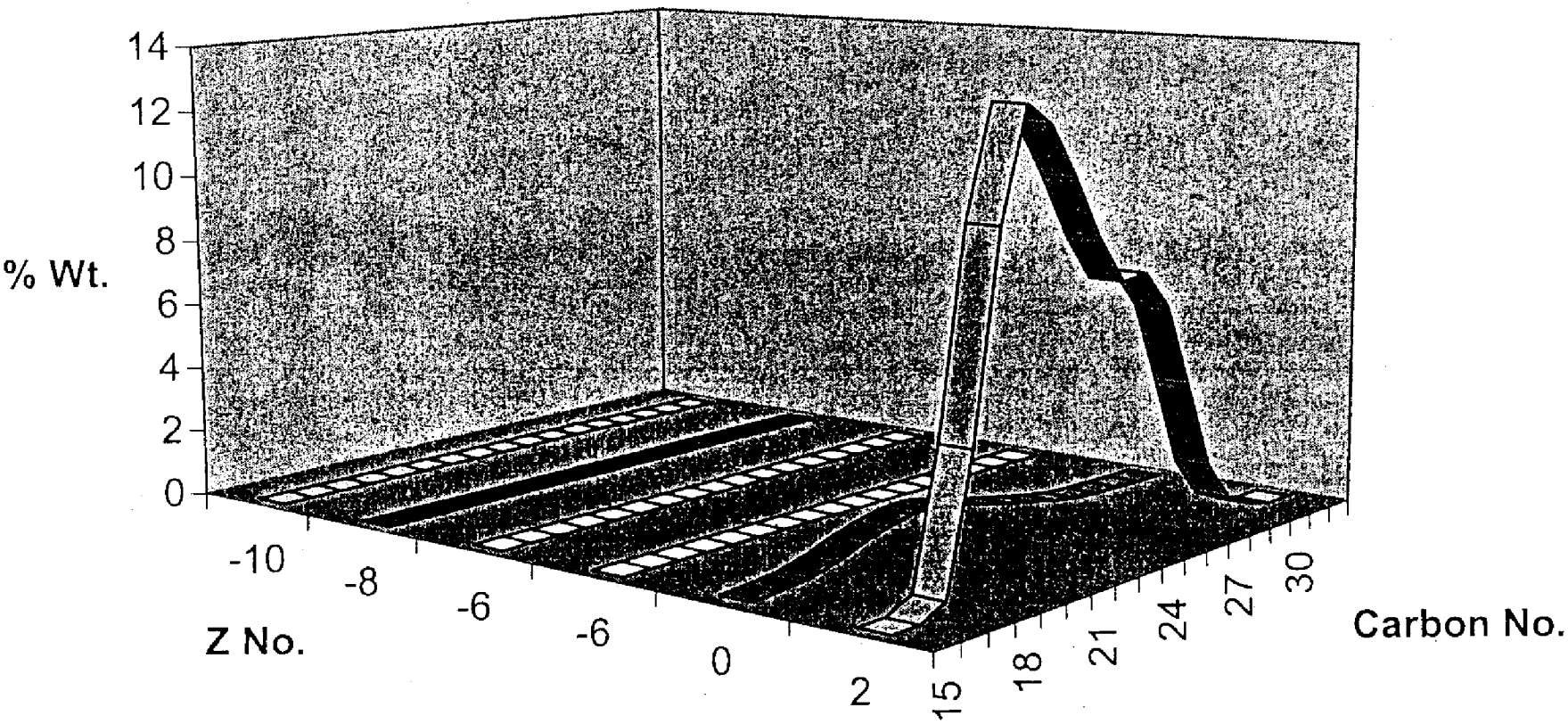
FIGS. 1 and 2 represent the carbon distribution of two Fischer-Tropsch derived base oils as used in the examples.

The base oil component is a paraffin base oil having a paraffin content of greater than 80 wt % paraffins and a saturates content of greater than 98 wt % and comprising a series of iso-paraffins having n, n+1, n+2, n+3 and n+4 carbon atoms and wherein n is between 20 and 35. Preferably the saturates content of the base oil as measured by IP386 is preferably greater than 98 wt %, more preferably greater than 99 wt % and even more preferably greater than 99.5 wt %. The base oil furthermore has preferably a content of naphthenic compounds of between 0 to 20%, preferably of from 1 and 20 wt %. It has been found that these base oils have a good additive response to the additives as listed above when aiming to improve for example oxidation stability. The base oil preferably has a kinematic viscosity at 40° C. of between 1 and 200 $mm^2$/sec, more preferably between 1 and 50 $mm^2$/sec and even more preferably between 1 and 15 $mm^2$/sec. The base oil may suitably have a kinematic viscosity at 100° C. of between 2 and 50 $mm^2$/sec, more preferably between 2 and 25 $mm^2$/sec, most preferably between 2 and 10 $mm^2$/sec. More preferably, if the oil formulation is used as a transformer oil, the base oil will preferably have a kinematic viscosity at 40° C. of between 5 and 15 $mm^2$/sec. If the electrical oil is used as a low temperature switch gear oil the base oil viscosity at 40° C. is preferably between 1 and 15 and more preferably between 1 and 4 $mm^2$/sec. The pour point of the base oil is preferably below −30° C.

The flash point of the base oil as measured by ASTM D92 is equal or greater than 170° C., preferably greater than 175° C., or more preferably even greater than 180° C. The flash point of the base oil will depend on the application of the oil. Applicants have found that the flash points of the base oils as claimed are advantageously high as compared to mineral oil derived base oils at a given viscosity. This is surprising in view of the fact that presence of isoparaffinic components should increase volatility and hence the reduce the flash point. Especially base oils having a vk100 of greater than 6 $mm^2$/sec having a flash point of greater than 250° C. can be advantageously used in fire resistant electrical oil formulations. The high flash point at comparatively low viscosity of the base oil component according to the present invention permits to formulate electrical oil formulations that have both low temperature performance, as well as an improved oxidation resistance. This is particularly important in applications wherein a high overall temperature exposure takes place, and or wherein high peak temperatures or so-called hotspots occur in the electrical oil, and/or wherein the increase in temperature cannot be easily deferred by the electrical oil due to restrictions in size or heat exchange capacity of a device containing nth2e electrical oil formulation. Examples of such devices or applications are small high capacity transformators, or safety switches. The content of naphthenic compounds and the presence of such a continuous series of iso-paraffins may be measured by Field desorption/Field Ionisation (FD/FI) technique. In this technique the oil sample is first separated into a polar (aromatic) phase and a non-polar (saturates) phase by making use of a high performance liquid chromatography (HPLC) method IP368/01, wherein as mobile phase pentane is used instead of hexane as the method states.

The saturates and aromatic fractions are then analyzed using a Finnigan MAT90 mass spectrometer equipped with a Field desorption/Field Ionisation (FD/FI) interface, wherein FI (a "soft" ionisation technique) is used for the determination of hydrocarbon types in terms of carbon number and hydrogen deficiency.

The type classification of compounds in mass spectrometry is determined by the characteristic ions formed and is normally classified by "z number". This is given by the general formula for all hydrocarbon species: $C_nH_{2n+z}$. Because the saturates phase is analysed separately from the aromatic phase it is possible to determine the content of the different iso-paraffins having the same stoichiometry or n-number. The results of the mass spectrometer are processed using commercial software (poly 32; available from Sierra Analytics LLC, 3453 Dragoo Park Drive, Modesto, Calif. GA95350 USA) to determine the relative proportions of each hydrocarbon type.

The base oil having the continuous iso-paraffinic series as described above are preferably obtained by hydroisomerisation of a paraffinic wax, preferably followed by some type of dewaxing, such as solvent or catalytic dewaxing. The paraffinic wax may be a slack wax. More preferably the paraffinic wax is a Fischer-Tropsch derived wax, because of its purity and high paraffinic content, as well as the fact that such waxes result in a product containing a continuous series of iso-paraffins having n, n+1, n+2, n+3 and n+4 carbon atoms in the desired molecular weight range The base oils as derived from a Fischer-Tropsch wax as here described will be referred to in this description as Fischer-Tropsch derived base oils.

Examples of Fischer-Tropsch processes which for example can be used to prepare the above-described Fischer-Tropsch derived base oil are the so-called commercial Slurry Phase Distillate technology of Sasol, the Shell Middle Distillate Synthesis Process and the "AGC-21" Exxon Mobil process. These and other processes are for example described in more detail in EP-A-776959, EP-A-668342, U.S. Pat. Nos. 4,943,672, 5,059,299, WO-A-9934917 and WO-A-9920720. Typically these Fischer-Tropsch synthesis products will comprise hydrocarbons having 1 to 100 and even more than 100 carbon atoms. This hydrocarbon product will comprise normal paraffins, iso-paraffins, oxygenated products and unsaturated products.

If base oils are one of the desired iso-paraffinic products it may be advantageous to use a relatively heavy Fischer-Tropsch derived feed. The relatively heavy Fischer-Tropsch derived feed has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch derived feed is preferably at least 0.2, more preferably at least 0.4 and most preferably at least 0.55. Preferably the Fischer-Tropsch derived feed comprises a $C_{20}$+ fraction having an ASF-alpha value (Anderson-Schulz-Flory chain growth factor) of at least 0.925, preferably at least 0.935, more preferably at least 0.945, even more preferably at least 0.955. Such a Fischer-Tropsch derived feed can be obtained by any process, which yields a relatively heavy Fischer-Tropsch product as described above. Not all Fischer-Tropsch processes yield such a heavy product. An example of a suitable Fischer-Tropsch process is described in WO-A-9934917.

The Fischer-Tropsch derived product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 mg/kg for sulphur and 1 mg/kg for nitrogen respectively.

The process will generally comprise a Fischer-Tropsch synthesis, a hydroisomerisation step and an optional pour point reducing step, wherein said hydroisomerisation step and optional pour point reducing step are performed as:

(a) hydrocracking/hydroisomerisating a Fischer-Tropsch product, (b) separating the product of step (a) into at least one or more distillate fuel fractions and a base oil or base oil intermediate fraction.

If the viscosity and pour point of the base oil as obtained in step (b) is as desired no further processing is necessary and the oil can be used as the base oil according the invention. If required, the pour point of the base oil intermediate fraction is suitably further reduced in a step (c) by means of solvent or preferably catalytic dewaxing of the oil obtained in step (b) to obtain oil having the preferred low pour point. The desired viscosity of the base oil may be obtained by isolating by means of distillation from the intermediate base oil fraction or from the dewaxed oil the a suitable boiling range product corresponding with the desired viscosity. Distillation may be suitably a vacuum distillation step.

The hydroconversion/hydroisomerisation reaction of step (a) is preferably performed in the presence of hydrogen and a catalyst, which catalyst can be chosen from those known to one skilled in the art as being suitable for this reaction of which some will be described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these. One type of preferred catalysts to be applied in the hydroconversion/hydroisomerisation step in accordance with the present invention are hydroconversion/hydroisomerisation catalysts comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0% by weight, more suitably from 0.2 to 2.0% by weight, calculated as element and based on total weight of carrier. If both present, the weight ratio of platinum to palladium may vary within wide limits, but suitably is in the range of from 0.05 to 10, more suitably 0.1 to 5. Examples of suitable noble metal on ASA catalysts are, for instance, disclosed in WO-A-9410264 and EP-A-0582347. Other suitable noble metal-based catalysts, such as platinum on a fluorided alumina carrier, are disclosed in e.g. U.S. Pat. No. 5,059,299 and WO-A-9220759.

A second type of suitable hydroconversion/hydroisomerisation catalysts are those comprising at least one Group VIB metal, preferably tungsten and/or molybdenum, and at least one non-noble Group VIII metal, preferably nickel and/or cobalt, as the hydrogenation component. Both metals may be present as oxides, sulphides or a combination thereof. The Group VIB metal is suitably present in an amount of from 1 to 35% by weight, more suitably from 5 to 30% by weight, calculated as element and based on total weight of the carrier.

The non-noble Group VIII metal is suitably present in an amount of from 1 to 25 wt %, preferably 2 to 15 wt %, calculated as element and based on total weight of carrier. A hydroconversion catalyst of this type, which has been found particularly suitable, is a catalyst comprising nickel and tungsten supported on fluorided alumina.

The above non-noble metal-based catalysts are preferably used in their sulphided form. In order to maintain the sulphided form of the catalyst during use some sulphur needs to be present in the feed. Preferably at least 10 mg/kg and more preferably between 50 and 150 mg/kg of sulphur is present in the feed.

A preferred catalyst, which can be used in a non-sulphided form, comprises a non-noble Group VIII metal, e.g., iron, nickel, in conjunction with a Group IB metal, e.g., copper, supported on an acidic support. Copper is preferably present to suppress hydrogenolysis of paraffins to methane. The catalyst has a pore volume preferably in the range of 0.35 to 1.10 ml/g as determined by water absorption, a surface area of preferably between 200-500 $m^2/g$ as determined by BET nitrogen adsorption, and a bulk density of between 0.4-1.0 g/ml. The catalyst support is preferably made of an amorphous silica-alumina wherein the alumina may be present within wide range of between 5 and 96 wt %, preferably between 20 and 85 wt %. The silica content as $SiO_2$ is preferably between 15 and 80 wt %. Also, the support may contain small amounts, e.g., 20-30 wt %, of a binder, e.g., alumina, silica, Group IVA metal oxides, and various types of clays, magnesia, etc., preferably alumina or silica.

The preparation of amorphous silica-alumina microspheres has been described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5-9.

The catalyst is prepared by co-impregnating the metals from solutions onto the support, drying at 100-150° C., and calcining in air at 200-550° C. The Group VIII metal is present in amounts of about 15 wt % or less, preferably 1-12 wt %, while the Group IB metal is usually present in lesser amounts, e.g., 1:2 to about 1:20 weight ratio respecting the Group VIII metal.

A typical catalyst is shown below:

| | |
|---|---|
| Ni, wt % | 2.5-3.5 |
| Cu, wt % | 0.25-0.35 |
| $Al_2O_3$—$SiO_2$ wt % | 65-75 |
| $Al_2O_3$ (binder) wt % | 25-30 |
| Surface Area | 290-325 $m^2/g$ |
| Pore Volume (Hg) | 0.35-0.45 ml/g |
| Bulk Density | 0.58-0.68 g/ml |

Another class of suitable hydroconversion/hydroisomerisation catalysts are those based on molecular sieve type materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates, such as SAPO-11 and SAPO-31. Examples of suitable hydroisomerisation/hydroisomerisation catalysts are, for instance, described in WO-A-9201657. Combinations of these catalysts are also possible. Very suitable hydroconversion/hydroisomerisation processes are those involving a first step wherein a zeolite beta or ZSM-48 based catalyst is used and a second step wherein a ZSM-5, ZSM-12, ZSM-22, ZSM-23, ZSM-48, MCM-68, ZSM-35, SSZ-32, ferrierite, mordenite based catalyst is used. Of the latter group ZSM-23, ZSM-22 and ZSM-48 are preferred. Examples of such processes are described in US-A-20040065581, which disclose a process comprising a first step catalyst comprising platinum and zeolite beta and a second step catalyst comprising platinum and ZSM-48.

Combinations wherein the Fischer-Tropsch product is first subjected to a first hydroisomerisation step using the amorphous catalyst comprising a silica-alumina carrier as described above followed by a second hydroisomerisation step using the catalyst comprising the molecular sieve has also been identified as a preferred process to prepare the base oil to be used in the present invention. More preferred the first and second hydroisomerisation steps are performed in series flow. Most preferred the two steps are performed in a single reactor comprising beds of the above amorphous and/or crystalline catalyst.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 65 wt %. The feed as used above in the definition is the total hydrocarbon feed fed to step (a), thus also any optional recycle of a high boiling fraction which may be obtained in step (b).

In step (b) the product of step (a) is preferably separated into one or more distillate fuels fractions and a base oil or base oil precursor fraction having the desired viscosity properties. If the pour point is not in the desired range the pour point of the base oil is further reduced by means of a dewaxing step (c), preferably by catalytic dewaxing. In such an embodiment it may be a further advantage to dewax a wider boiling fraction of the product of step (a). From the resulting dewaxed product the base oil and oils having a desired viscosity can then be advantageously isolated by means of distillation. Dewaxing is preferably performed by catalytic dewaxing as for example described in WO-A-02070629, which publication is hereby incorporated by reference. The final boiling point of the feed to the dewaxing step (c) may be the final boiling point of the product of step (a) or lower if desired.

The additive component (ii) of the oil formulation comprises an anti-oxidant additive. It has been found that especially the combination of the above described base oil and the anti-oxidant additive improves significantly the total acidity values of the oil as tested in the Oxidation test IEC 61125 C. The base oil may be combined with the anti-oxidant as the only additive or in combination with other additives as described below. The anti-oxidant may be a so-called hindered phenolic or amine antioxidant, for example naphthols, sterically hindered monohydric, dihydric and trihydric phenols, sterically hindered dinuclear, trinuclear and polynuclear phenols, alkylated or styrenated diphenylamines or ionol derived hindered phenols. Sterically hindered phenolic antioxidants of particular interest are selected from the group consisting of 2,6-di-tert-butylphenol (IRGANOX™ L 140, CIBA), di tert-butylated hydroxotoluene (BHT), methylene-4,4'-bis-(2,6-tert-butylphenol), 2,2'-methylene bis-(4,6-di-tert-butylphenol), 1,6-hexamethylene-bis-(3,5-di-tert-butyl-hydroxy-hydrocinnamate) (IRGANOX™ L109, CIBA), ((3,5-bis(1,1-dimethylethyl)-4-hydroxyphenyl)methyl)thio) acetic acid, C10-C14 isoalkyl esters (IRGANOX™ L118, CIBA), 3,5-di-tert-butyl-4-hydroxyhydrocinnamic acid, C7-C9alkyl esters (IRGANOX™ L135, CIBA) tetrakis-(3-(3,5-di-tert-butyl-4-hydroxyphenyl)-propionyl-oxymethyl) methane (IRGANOX™ 1010, CIBA), thiodiethylene bis(3,5-di-tert-butyl-4-hydroxy-hydrocinnamate (IRGANOX™ 1035, CIBA), octadecyl 3,5-di-tert-butyl-4-hydroxyhydrocinnamate (IRGANOX™ 1076, CIBA) and 2,5-di-tert-butyl-hydroquinone. These products are known and are commercially available. Of most particular interest is 3,5-di-tert-butyl-4-hydroxy-hydrocinnamic acid-C7-C9-alkyl ester.

Examples of amine antioxidants are aromatic amine antioxidants for example N,N'-Di-isopropyl-p-phenylenediamine, N,N'-di-sec-butyl-p-phenylenediamine, N,N'-bis(1,4-dimethyl-pentyl)-p-phenylenediamine, N,N'-bis(1-ethyl-3-methyl-pentyl)-p-phenylene-diamine, N,N'-bis(1-methyl-heptyl)-p-phenylenediamine, N,N'-dicyclohexyl-p-phenylene-diamine, N,N'-diphenyl-p-phenylenediamine, N,N'-di(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N'-cyclohexyl-N'-phenyl-p-phenylenediamine, 4-(p-toluene-sulfoamido)diphenylamine, N,N'-dimethyl-N,N'-di-sec-butyl-p-phenylenediamine, diphenylamine, N-allyldiphenylamine, 4-isopropoxy-diphenylamine, N-phenyl-1-naphthylamine, N-phenyl-2-naphthylamine, octylated diphenylamine, e.g. p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di(4-methoxyphenyl)amine, 2,6-di-tert-butyl-4-dimethylamino-methylphenol, 2,4'-diamino-diphenylmethane, 4,4'-diaminodiphenylmethane, N,N,N',N'-tetramethyl-4,4'-diaminodiphenylmethane, 1,2-di(phenylamino)ethane, 1,2-di[(2-methylphenyl)amino] ethane, 1,3-di(phenylamino)-propane, (o-tolyl)biguanide, di[4-(1',3'-dimethyl-butyl)phenyl]amine, tert-octylated N-phenyl-1-naphthylamine, mixture of mono- and dialkylated tert-butyl-/tert-octyldiphenylamines, 2,3-dihydro-3,3-dimethyl-4H-1,4-benzothiazine, phenothiazine, N-allylphenothiazine, tert-octylated phenothiazine, 3,7-di-tert-octylphenothiazine. Also possible amine antioxidants are those according to formula VIII and IX of EP-A-1054052, which compounds are also described in U.S. Pat. No. 4,824,601, which publications are hereby incorporated by reference.

The content of the anti oxidant additive is preferably less than 2 wt % and more preferably less than 1 wt %. The content is preferably less than 0.6 wt % in certain applications, such as when the oil formulation is used as an electrical oil. The content of antioxidant is preferably greater than 10 mg/kg. If the anti-oxidant is present as the only additive or at least in the absence of the sulphur or phosphorus containing compound or in the absence of such P- or S-compound and in the absence of the copper passivator then the content of anti-oxidant is preferably between 0.01 and 0.4 wt %, more preferably between 0.04 and 0.3 wt %. Yet more preferably, between 10 mg/kg and 0.3 wt % of a di-t-butylated hydroxotoluene antioxidant additive is present in the electrical oil formulation according to the invention.

The oil formulation preferably comprises also a copper passivator, also sometimes referred to as an electrostatic discharge depressant or metal deactivator. Examples of possible copper passivator additives are N-salicylideneethylamine, N,N'-disalicylidene-ethyldiamine, triethylenediamine, ethylenediammine-tetraacetic acid, phosphoric acid, citric acid and gluconic acid. More preferred are lecithin, thiadiazole, imidazole and pyrazole and derivates thereof. Even more preferred are zinc dialkyldithiophosphates, dialkyldithiocarbamates and benzotriazoles and their tetrahydroderivates. Most preferred are the compounds according to formula (II) or even more preferred the optionally substituted benzotriazole compound represented by the formula (III)

(II)

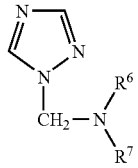

(III)

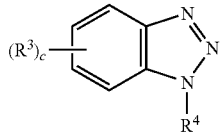

wherein R4 may be hydrogen or a group represented by the formula (IV)

(IV)

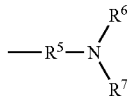

or by the formula (V)

(V)

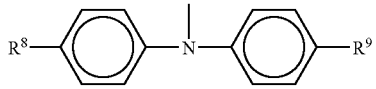

wherein:

c is 0, 1, 2 or 3;

$R^3$ is a straight or branched $C_{1-4}$ alkyl group.

Preferably $R^3$ is methyl or ethyl and C is 1 or 2. $R^5$ is a methylene or ethylene group. More preferably, $R^6$ and $R^7$ are hydrogen or the same or different straight or branched alkyl groups of 1-18 carbon atoms, preferably a branched alkyl group of 1-12 carbon atoms; $R^8$ and $R^9$ are the same or different alkyl groups of 3-15 carbon atoms, preferably of 4-9 carbon atoms.

Preferred compounds are 1-[bis(2-ethylhexyl)amino-methyl]benzotriazole, methylbenzotriazole, dimethyl-benzotriazole, ethylbenzotriazole, ethylmethyl-benzotriazole, diethylbenzotriazole and mixtures thereof. Examples of copper passivator additives as described above are described in U.S. Pat. No. 5,912,212, EP-A-1054052 and in US-A-2002/0109127, which publications are hereby incorporated by reference. These benzotriazoles compounds are preferred because they also act as an electrostatic discharge depressant, which is beneficial when the oil formulation is used as an electrical oil. Copper passivator additives as those described above are commercially available under the product names IRGAMET 39, IRGAMET30 and IRGAMET 38S from CIBA Ltd Basel Switzerland, also traded under the trade name Reomet by CIBA.

The content of the above copper passivator in the oil formulation is preferably above 1 mg/kg and more preferably above 5 mg/kg. A practical upper limit may vary depending on the specific application of the oil formulation. For example, when desiring improved dielectric discharge tendencies of the oil for use as electrical oil it may be desired to add a high concentration of the copper passivator additive. This concentration may be up to 3 wt %. Applicants however found that the advantages of the invention can be achieved at concentrations below 1000 mg/kgw and more preferably below 300 mg/kg, even more preferably below 50 mg/kg.

It has been found that when between 1 and 1000 mg/kg of a sulphur or phosphorus containing additive is also part of the additive component (ii) the desired properties are even more enhanced. Preferred sulphur and phosphorus containing compounds are sulfides, phopshides, dithiophopsphates and dithiocarabamates. Preferably an organic polysulphide compound is used. With polysulphide is here meant that the organic compound comprises at least one group where two sulphide atoms are directly linked. A preferred polysulfide compound is a disulfide compound. Preferred polysulphide compounds are represented by the formula (I)

$$R^1—(S)a-R^2 \quad (I)$$

wherein:

a is 2, 3, 4 or 5;

$R^1$ and $R^2$ may be the same or different and each may be straight or branched alkyl group of 1 to 22 carbon atoms, aryl groups of 6-20 carbon atoms, alkylaryl groups of 7-20 carbon atoms or arylalkyl groups of 7-20 carbon atoms. Preferred are arylalkyl groups, more preferred are optionally substituted benzyl groups. More preferably $R^1$ and $R^2$ are independently selected from a benzyl group or a straight or branched dodecyl group. Examples of possible sulphur and phosphorus containing compounds and the preferred compounds mentioned here are described in the aforementioned U.S. Pat. No. 5,912,212 as its component (b), which publication is incorporated by reference. An Examples of a suitable disulfide compounds are dibenzyldisulfide, ditertdodecyldisulfide and didodecyldisulfide. The electrical oil formulation according to the invention has a sulphur content of below 4 wt %. The content of the organic sulphur or phosphorus additive in the oil formulation is preferably less than 0.1 wt % of the formulation, more preferably less than 800 mg/kg and even more preferably less than 400 mg/kg. The lower limit is preferably 1 mg/kg more preferably 10 mg/kg, most preferably 50 mg/kg. The oil formulation may comprise as the base oil exclusively the base oil as described above or alternatively in combination with another base oil. The additional base oil will suitably comprise less than 20 wt %, more preferably less than 10 wt % of the total electrical oil formulation. Examples of such base oils are mineral based paraffinic and naphthenic type base oils and synthetic base oils, for example esters, poly alpha olefins, poly alkylene glycols and the like. Esters are beneficial in order to improve the biodegradability of the oil formulation. Applicants found that for the low viscosity base oil, having a kinematic viscosity at 100° C. of between 1 and 3 $mm^2$/sec, the biodegradability of the oil is qualified as readily biodegradable according to ISO 14593. It is known that Fischer-Tropsch derived base oils may have biodegradable properties as described in for example EP-A-876446. However in said publication the biodegradability was measured using the CEC-L-33-T-82 test. Applicants have now found that base oils derived from a Fischer-Tropsch product and having the properties of the base oils as disclosed in EP-A-876446 are not always readily biodegradable according to the more accurate testing method as laid down in ISO 14593. It is widely known that the CEC-L-32-T-82 test and the more recent version of this test, known as the CEC L-33-A-93, can overestimate the biodegradability when compared to the ultimate biodegradability as measured by ISO 14593.

The content of the additional ester base oil is preferably between 1 and 30 wt %, more preferably between 5 and 25 wt %. Suitable ester compounds are ester compounds derivable by the reaction of an aliphatic mono, di and/or poly carboxylic acid with iso-tridecyl alcohol under esterification conditions. Examples of said ester compounds are isotridecyl ester of octane-1,8-dioic acid, 2-ethylhexane-1,6 dioic acid and dodecane-1,12-dioic acid. Preferably the ester compound is a so-called pentaerythritol tetrafattyacid ester (PET ester) as made by esterification of pentaerythritol (=PET) with branched or linear fatty acids, preferably C6-C10 acids. The ester may contain di-PET as alcohol component as an impurity.

It has been found especially advantageous to use a Fischer-Tropsch derived base oil as the substantially the sole base oil component. With substantially is here meant that more than 70 wt %, more preferably more than 90 wt % and most preferably 100 wt % of the base oil component in the oil formulation is a Fischer-Tropsch derived base oil as described in detail above.

The oil formulation preferably has a sulphur content of below 0.5 wt % and even more preferably below 0.15 wt %. The source of the majority of the sulphur in the oil formulation will be the sulphur as contained in any additional mineral based base oil component and the optional sulphur containing additives which may be present in the oil formulation according the invention.

In addition to the additive as described above for the component (ii) additional additives may also be present. The type of additives will depend on the specific application. Without intending to be limiting, examples of possible additives are dispersants, detergents, viscosity modifying polymers, hydrocarbon or oxygenated hydrocarbon type pour point depressants, emulsifiers, demulsifiers, antistaining additives and friction modifiers. Specific examples of such additives are described in for example Kirk-Othmer Encyclopedia of Chemical Technology, third edition, volume 14, pages 477-526. Suitably the dispersant is an ashless dispersant, for example polybutylene succinimide polyamines or Mannic base type dispersants. Suitably the detergent is an over-based metallic detergent, for example the phosphonate, sulfonate, phenolate or salicylate types as described in the above referred to General Textbook. Suitably the viscosity modifier is a viscosity modifying polymer, for example polyisobutylenes, olefin copolymers, polymethacrylates and polyalkylstyrenes and hydrogenated polyisoprene star polymer (Shellvis). Examples of suitable antifoaming agents are polydimethylsiloxanes and polyethylene glycol ethers and esters.

In order to improve the gassing tendency of the oil formulation it is preferred to add between 0.05 and 10 wt %, preferably between 0.1 and 5 wt % of an aromatic compound.

Preferred aromatic compounds are for example tertrahydronaphthalene, diethylbenzene, di-isopropylbenzene, a mixture of alkylbenzenes as commercially obtainable as "Shell Oil 4697" or "Shellsol A 150" both "Shell" products obtainable from Shell Deutschland GmbH. Another preferred mixture of aromatic compounds is comprised in a mixture of 2,6-di-t-butyl phenol and 2,6-di-t-butyl cresol. Preferably the oil formulation comprises between 0.1 and 3 wt % of 2,6-di-t-butyl phenol and 0.1 to 2 wt % of 2,6-di-t-butyl cresol in a weight ratio of between 1:1 and 1:1.5.

The oil formulation is preferably subjected to an additional clay treatment.

The present invention accordingly further relates to an electrical oil composition comprising a base oil component derived from Fischer Tropsch synthesis products and an additive, wherein (i) at least 80 wt % of the base oil component is a paraffin base oil having a paraffin content of greater than 80 wt % paraffins and a saturates content of greater than 98 wt % and comprising a series of iso-paraffins having n, n+1, n+2, n+3 and n+4 carbon atoms and wherein n is between 20 and 35; and an anti-oxidant additive, wherein the electrical oil formulation has been subjected to a clay treatment.

Preferably the clay treatment is performed on the oil formulation, more preferably comprising the sulphur or phosphorous containing additive if present. The anti-oxidant and copper passivator additives are preferably added to the oil formulation after performing the clay treatment. Clay treatment is a well know treatment to remove polar compounds from the oil formulation. It is performed in order to further improve the colour, chemical and thermal stability of the oil formulation. It may be performed prior to adding the additives mentioned in this description on a, partly, formulated oil formulation. Clay treatment processes are for example described in Lubricant base oil and wax processing, Avilino Sequeira, Jr., Marcel Dekker, Inc, New York, 1994, ISBN 0-8247-9256-4, pages 229-232. Applicants have found that the oxidative stability of an electrical oil formulation based on a blend of a Fischer-Tropsch derived base oil and a mineral oil derived base oil and an anti-oxidant additive can be increased by a clay treatment.

The above oil formulation is especially suited to be used as an electrical oil because of its good oxidative stability, low sludge formation and also excellent low temperature viscosity values. Examples of applications are switch gears, transformers, regulators, circuit breakers, power plant reactors, cables and other electrical equipment. Preferred electrical oil applications are a transformer oil and a low temperature switch gear oil. Such applications are well known to the skilled person and described for example in Lubricants and related products, Dieter Klamann, Verlag Chemie GmbH, Weinhem, 1984, pages 330-337. A problem often encountered when using an electrical oil in said applications based on a naphthenic base oil is that the kinematic viscosity at −30° C. is too high. When such an oil would be used in application which have to start up at low temperatures, especially at temperatures below 0° C., the higher viscosity will have a negative effect on the required heat dissipation of the electrical oil. Overheating of the equipment can result. Applicants have found that when the oil formulation according to the present invention is used, especially when the base oil has a kinematic viscosity at 40° C. of between 1 and 15 $mm^2$/sec and a pour point of below −30° C., more preferably below −40° CC, an electrical oil formulation is obtained having the above desired properties. These oils furthermore show a very low dielectric dissipation factor, even after prolonged testing at elevated temperature. The low dissipation factor is indicative for a low loss of electric power in the application wherein the electrical oil is used. Because the dissipation factor does not significantly increase over time, especially when compared to the naphthenic based electrical oil formulations, a very efficient application of the oil results.

In another embodiment of the present invention the oil formulation is preferably used as a low temperature switch gear formulation. Traditionally low temperature switch gear formulations are formulated using a low viscous mineral base oils. However, a problem with known low temperature switch gear fluids is that they have, as a result of their (low) viscometric properties, a low flash point. This problem is even more pertinent in arctic regions requiring very low viscosities. Applicants now found that by using a base oil as described above, especially a Fischer-Tropsch derived base oil, a switch gear fluid formulation having excellent viscometric properties at low temperatures can be obtained, making the formulation suitable for the use as a low temperature switch gear formulation. A further advantage is that the base oil has a high flash point allowing the switch gear fluid to be safely used under very critical switching operations, for example in a so-called high-load grid.

The low temperature switch gear oils as described above may find use in applications which have to start up regularly, especially more than 10 times per year at a temperature of below 0° C., more preferably below −5° C., wherein the temperature of the oil when the application is running is above 0° C.

Another preferred electrical oil application is the fire resistant electrical oil application. The base oil is said application preferably has a kinematic viscosity at 100° C. of above 6 $mm^2$/sec, more preferably above 7 and suitably below 12 $mm^2$/sec. It has been found that the paraffinic base oils in this viscosity range have a high flash point of greater than 250° C. and preferably greater than 260° C., making them very suitable for such applications. Such formulations require low flammability and improved fire safety characteristics. These oils are suitably used as transformer oil used in indoor or underground environments.

Applicants found that the low viscosity base oil is readily biodegradable. The biodegradability can be further improved by adding an ester based base oil to said formulation as described above. In a further embodiment of the present invention the oil formulation can thus be advantageously used in those applications, which require a biodegradable base oil in said formulation. Especially the oil formulation is used as a transformer oil in mobile electrical equipment, especially trains, electrical powered cars or hybrid powered cars. The oil formulations may also find advantageous use in equipment used in environmental sensitive areas, such as for example national parks, conservation areas, water protection areas, potable water storage facilities and the like.

The invention will be illustrated with the following non-limiting examples. In the examples use has been made of four different types of base oils. One Fischer-Tropsch derived base oil, referred to as GTL BO, two naphthenic type of base oils, referred to as naphthenic-1 and naphthenic-2, and a mineral paraffinic base oil. The properties of these base oils are listed in Table 1.

TABLE 1

Figure 2:
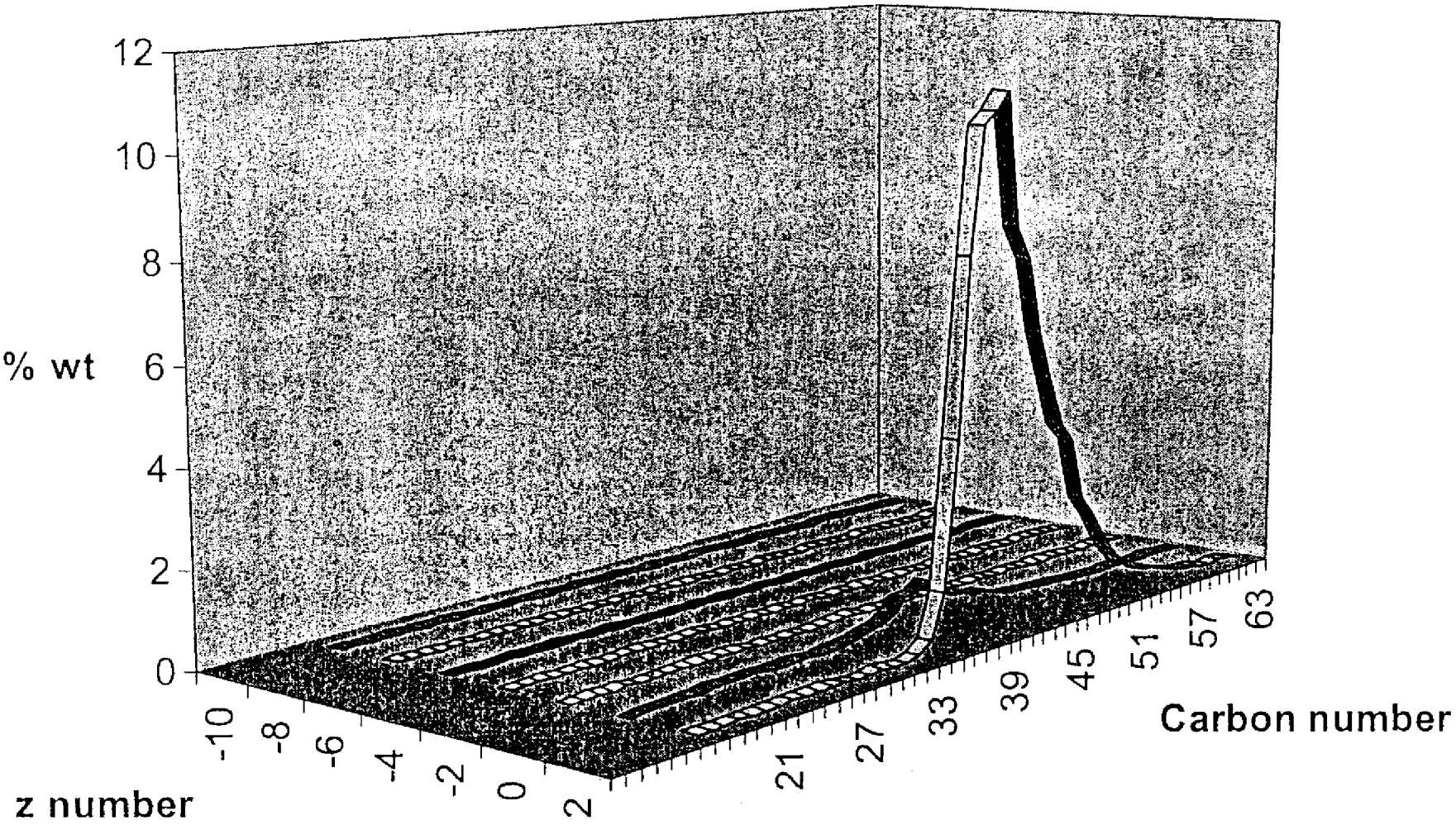

| Base Oil | | | GTL BO-1 | GTL BO-2 | GTL BO-3 | Naphthenic-1 | Naphthenic-2 | Paraffinic-1 | Paraffinic-2 |
|---|---|---|---|---|---|---|---|---|---|
| Vk @ 100° C. | ASTM D445 | $mm^2/s$ | 2.4 | 4.0 | 7.8 | 2.1 | 2.1 | 2.2 | 8.3 |
| Vk @ 40° C. | ASTM D445 | $mm^2/s$ | 7.9 | | | 8.8 | 7.8 | 8.0 | 75.1 |
| VI | ASTM D2270 | | 126 | 135 | 148 | <0 | 47 | 88 | 73 |
| Pour Point | ASTM D5950 | ° C. | −51 | −30 | −24 | −60 | −60 | −15 | −18 |
| Flash point | ASTM D92 | ° C. | 192 | 228 | 274 | 147 | 154 | 186 | 232 |
| Paraffins by FD/FI technique | | (wt %) | 90.7 | 92.3 | 90.8 | | | | |
| Carbon distribution | | | See FIG. 1(*) | | FIG. 2(*) | | | | |
| Basic Nitrogen | ISO 3771mod | mg/kg | | | | 4 | <1 | 1 | 3 |
| Sulphur | ISO 14596 | % m | <0.001 | | | 0.075 | 0.001 | 0. 015 | 0.021 |
| Colour | ASTM D2049 | | L0.5 | | | L0.5 | L0.5 | L0.5 | L1.5 |
| Biodegradation after 28 days | ISO 14593 | % | 60 | | | | | | |

(*)Carbon distribution per carbon number as measured by Field desorption/Field Ionisation (FD/FI) technique, wherein Z = 2 represents the iso and normal paraffins, Z = 0 the 1-ring naphthenic compounds, Z = −2 the 2-ring naphthenic compounds, Z = −4 the 3-ring naphthenic compounds etc.

EXAMPLE 1

Starting with the naphthenic-1, mineral paraffin base oil-1 and the GTL base oil-1 of Table 1 five different oil mixtures according to the additivation schemes 1-8 of table 2 were made. For all of these oil mixtures the Sludge Formation was measured according to the Oxidation Test IEC 61125 C at 164 h/120° C. The lower the value the less sludge is found. The results are also presented in Table 2.

TABLE 2

| Sludge formation according to IEC 61125 C | | | | | | | | | |
|---|---|---|---|---|---|---|---|---|---|
| Additivation scheme | | 1 | 2 | 3 | 4 | 5 | 6 | 7 | 8 |
| Dibenzyldisulfide | mg/kg | — | — | 200 | 200 | 200 | 200 | | |
| 1-[bis(2-ethylhexyl)-aminomethyl]benzotriazole (Reomet38S) | mg/kg | — | 10 | — | 10 | 10 | | 10 | |
| Antioxidant BHT | % m | — | — | — | — | 0.08 | 0.08 | 0.08 | 0.3 |
| Naphthenic base oil | Sludge | 1.700 | 1.530 | 0.561 | 0.281 | 0.295 | | | |
| Paraffinic base oil-1 | Sludge | 3.340 | 2.440 | 0.209 | 0.086 | <0.006 | | | |
| GtL base oil-1 | Sludge | 0.085 | 0.023 | 0.043 | 0.071 | 0.006 | 0.006 | 0.006 | <0.006 |

For all of these oil mixtures according to additivation schemes 1-5 of above also the Total Acidity using the Oxidation Test IEC 61125 C at 164 h/120° C. was measured. The lower the value the less acid compounds are formed and the more oxidative stable the oil formulation is. The results are presented in Table 3.

TABLE 3

| Additivation scheme | | 1 | 2 | 3 | 4 | 5 | 6 | 7 | 8 |
|---|---|---|---|---|---|---|---|---|---|
| Dibenzyldisulfide | mg/kg | — | — | 200 | 200 | 200 | 200 | | |
| 1-[bis(2-ethylhexyl)amino-methyl]benzotriazole | mg/kg | — | 10 | — | 10 | 10 | | 10 | |
| Antioxidant BHT | Wt % | — | — | — | — | 0.08 | 0.08 | 0.08 | 0.3 |
| Total acidity according to IEC 61125 C | | | | | | | | | |
| Naphthenic base oil-1 | Mg KOH/g | 4.14 | 3.87 | 1.59 | 0.83 | 1.02 | | | |
| Paraffinic base oil-1 | Mg KOH/g | 9.12 | 6.78 | 0.78 | 0.38 | 0.02 | | | |
| GTL Base Oil-1 | Mg KOH/g | 13.67 | 10.55 | 12.65 | 12.57 | 0.10 | <0.01 | <0.01 | 0.02 |

EXAMPLE 2

4 oil mixtures were prepared according to the scheme as presented in Table 4. Two oil mixtures were subjected to a clay treatment using Tonsil 411 clay as obtainable from Sued Chemie, Munchen (D). The anti-oxidant and copper passivator additives were added after the clay treatment. The properties of the oil mixtures were measured and the oil mixtures were subjected to the IEC OXIDATION TEST at 500 h/120° C.

TABLE 4

| Sample Identification | | | U | V | X | Y | Z | W |
|---|---|---|---|---|---|---|---|---|
| GTL base oil-1 | Wt % | | 99.61 | 99.3 | 99.68 | — | 94.68 | — |
| Naphthenic-1 | wt % | | | | — | 99.68 | | 94.68 |
| Mineral paraffinic base oil-1 | Wt % | | | | — | — | 5.00 | 5.00 |
| Dibenzyldisulfid | Wt % | | 0.09 | 0.4 | 0.02 | 0.02 | 0.02 | 0.02 |
| Clay treatment (Tonsil) | % | | | | — | — | 1 | 1 |
| 1-[bis(2-ethylhexyl)amino-methyl]benzotriazole | mg/kg | | 10 | 10 | 10 | 10 | 10 | 10 |
| Antioxidant BHT | Wt % | | 0.30 | 0.30 | 0.30 | 0.30 | 0.30 | 0.30 |
| | | Properties of the oil mixtures | | | | | | |
| FLASH POINT | | ISO 2719 | | | 160 | 145 | 160 | 145 |
| POUR POINT | ° C. | DIN ISO 3016 | | | <−60 | <−60 | −51 | −54 |
| KIN. VISCOSITY −30° C. | $mm^2/s$ | DIN 51562 | | | 341 | 1140 | 368 | 1210 |
| KIN. VISCOSITY 40° C. | $mm^2/s$ | DIN 51562 | | | 8 | 8.7 | 8 | 9 |
| KIN. VISCOSITY 100° C. | $mm^2/s$ | DIN 51562 | | | 2.4 | 2.2 | 2.4 | 2.2 |
| BREAKDOWN VOLTAGE | kV | VDE 0370-5 | | | | | 84 | |
| DIELECTR. DISSIPATION FACTOR 90° C. | | VDE 0370-1 | | | | | 0.0002 | |
| KORRO. SULFUR Ag/100° C. | | DIN 53 353 | Fail (*) | Fail (**) | | | pass | pass |
| | | IEC OXIDATION TEST 500 h/120° C.: IEC 61125/C | | | | | | |
| Total acidity after 500 h/120° C. test | mgKOH/g | IEC 61125/C | | | <0.01 | 0.69 | 0.02 | 0.41 |
| Sludge after 500 h/120° C. test | m % | IEC 61125/C | | | <0.006 | 0.202 | <0.006 | 0.043 |
| Dielectr. Dissip. F. 90° C. after 500 h/120° C. test | | IEC 61125/C | | | 0.0015 | 0.1021 | <0.0035 | 0.1017 |

(*) light grey discolouration (**) grey discolouration

Table 4 shows that the oil formulation based on the Fischer-Tropsch derived base oil has a low viscosity at −30° C. in combination with excellent oxidative stability properties. The gassing tendency of the Mixture Z of Table 4 can be improved by adding an aromatic solvent as illustrated in Table 5.

TABLE 5

| Sample Identification | | Z | Z' |
|---|---|---|---|
| GTL base oil-1 | Wt % | 94.68 | 94.18 |
| Mineral Paraffinic base oil-1 | Wt % | 5.00 | 5.00 |
| Dibenzyldisulfid | Wt % | 0.02 | 0.02 |
| Clay treatment (Tonsil) | Wt % | 1 | 1 |
| 1-[bis(2-ethylhexyl)amino-methyl]benzotriazole | Mg/kg | 10 | 10 |
| Shellsol A 150 (aromatic hydrocarbon solvent) | Wt % | | 0.5 |
| Antioxidant BHT | Wt % | 0.30 | 0.30 |

TABLE 5-continued

| Sample Identification | | Z | Z' |
|---|---|---|---|
| GASSING TENDENCY measured according to BS 5797 | $mm^3/min$ | >0 | −8.9 |

EXAMPLE 3

Three oil formulations A-C were made using the GTL Base Oils 1, 2 and 3 of Table 1 according to the formulations as listed in Table 6. The oil formulations A-C were subjected to a clay treatment using Tonsil 411 clay as obtainable from Sued Chemie, Munchen (D). The anti-oxidant and copper passivator additive were added after the clay treatment.

The oils were tested with the test methods listed in Table 6. The results show that excellent oils for use as electrical oils.

TABLE 6

| Oil properties | | | Oil A | Oil B | Oil C |
|---|---|---|---|---|---|
| Formulation | | | | | |
| GTL BO-1 | Wt % | | 94.7 | | |
| GTL BO-2 | Wt % | | | 98.7 | |
| GTL BO-3 | Wt % | | | | 98.7 |
| Paraffinic-base oil 1 | Wt % | | 5.0 | | |
| Paraffinic-base oil 2 | wt % | | | 1.0 | 1.0 |
| Dibenzyldisulfide | mg/kg | | 200 | 200 | 200 |
| 1-[bis(2-ethyl-hexyl)aminomethyl]-benzotriazole | mg/kg | | 10 | 10 | 10 |
| Ionol 861805 | % | | 0.3 | 0.3 | 0.3 |
| Test results | | | | | |
| TEST | DIMENS. | METHODE | | | |
| FLASH POINT | ° C. | ISO 2592 | 160 | 226 | 263 |
| POUR POINT | ° C. | DIN ISO 3016 | −51 | −30 | −18 |
| KIN. VISCOSITY 40° C. | $Mm^2/s$ | DIN 51562 | 7.8 | 17.5 | Not measured |
| KIN. VISCOSITY 100° C. | $Mm^2/s$ | DIN 51562 | 2.4 | 4.1 | 7.8 |
| IEC OXIDATION TEST 500 h/120° C. IEC 61125/C | | | | | |
| Total acidity | mgKOH/g | | 0.02 | 0.02 | 0.04 |
| Sludge | Gew. % | | <0.006 | <0.008 | <0.007 |
| Dielectr. Dissip. F. 90° C. | | | 0.0035 | 0.0004 | 0.0004 |

EXAMPLE 4

Four oil mixtures were tested for their biodegradability according to ISO 14593. The results are presented in Table 7. From Table 7 it can be seen that a biodegradable base oil or base oil mixture for use in a transformer oil according to IEC 60296 specification is provided. Oil formulations using exclusively the ester base oil did not meet the kinematic viscosity at 40° C. specification.

This is advantageous because as a rule ester base oils are more difficult to prepare, and hence expensive, than the Fischer-Tropsch derived base oils.

TABLE 7

| Formulation | | | Identification | | | | | | |
|---|---|---|---|---|---|---|---|---|---|
| | | | Oil | GTL BO-1 | GTL BO-1/ ester | GTL BO-1/ ester | Ester formula-tion | IEC 60296 Trans-former Oil | IEC 61099 Type T1 |
| GTL BO-1 | % | | 99.92 | 100.0 | 80.0 | 60.0 | | | |
| Dibenzyldisulfide | ppm | | 200 | | | | | | |
| 1-[bis(2-ethylhexyl)aminomethyl]-benzotriazole | ppm | | 10 | | | | | | |
| Pentaerythrittetrafettsäureester ($C_6$-$C_{10}$) (CAS 68987-94-0) | | | | | 20.0 | 40.0 | 99.7 | 99.7 | 99.7 |
| Antioxidant BHT | wt % | | 0.08 | | | | 0.3 | | |
| TEST | | METHODE | | | | | | | |
| FLASH POINT | ° C. | ISO 2719 | 160 | 160 | >160 | >160 | 265 | min. 135 | min. 250 |
| POUR POINT | ° C. | DIN ISO 3016 | −51 | −51 | −52 | −54 | −60 | max. −40 | max. −45 |
| KIN. VISCOSITY 40° C. | $mm^2/s$ | DIN 51562 | 7.8 | 7.8 | 9.8 | 12.5 | 31.9 | max. 12 | max. 35 |
| KIN. VISCOSITY 100° C. | $mm^2/s$ | DIN 51562 | 2.4 | 2.4 | 2.7 | 3.3 | 5.7 | | |
| DIELECTR. DISSIPATION FACTOR 90° C. | | VDE 0370-1 | 0.0010 | | | | 0.0100 | max. 0.005 | |
| BREAK DOWN VOLTAGE | kV | IEC 61156 | >70 | | | | 82 | min. 70 | min. 45 |
| IEC OXIDATION TEST 164 h/120° C. | | IEC 61125/C | | | | | 82 | min. 70 | min. 45 |
| Total acidity | mgKOH/g | | 0.10 | | | | 0.04 | max. 1.2 | max. 0.3 |
| Sludge | Gew. % | | 0.006 | | | | 0.002 | max. 0.8 | max. 0.01 |
| Biodegradation after 28 days | % | ISO 14593 | | 60 | 63 | 70 | >60 | | |

What is claimed is:

1. An electrical oil formulation consisting essentially of:

(i) at least 80 wt % of a base oil component comprising a paraffinic base oil having a paraffin content of greater than 80 wt % paraffins and a saturates content of greater than 98 wt % and comprising a series of iso-paraffins having n, n+1, n+2, n+3 and n+4 carbon atoms and wherein n is between 20 and 35;

(ii) an phenolic or amine anti-oxidant additive;

(iii) an aromatic anti-gassing compound;

(iv) a copper passivator additive; and (v) a sulphur or phosphorus containing additive;

wherein the base oil component has a flash point of at least 170° C., as determined by ISO 2592;

wherein the paraffinic base oil is obtained by hydroisomerisation of a Fischer-Tropsch derived wax, followed by dewaxing; and wherein the formulation comprises between 0.05 and 10 wt % of an aromatic anti-gassing compound selected from the group consisting of:

tertrahydronaphthalene, diethylbenzene, di-isopropylbenzene, mixtures of alkylbenzenes, and mixtures of 2,6-di-t-butyl phenol and 2,6-di-t-butyl cresol.

2. The formulation according to claim 1, wherein the paraffin base oil has a kinematic viscosity at 40° C. of between 1 and 200 $mm^2/sec$.

3. The formulation according to claim 1, wherein the paraffin base oil has a kinematic viscosity at 40° C. of between 1 and 15 $mm^2/sec$, a pour point of below −30° C.

4. The formulation according to claim 1, wherein the content of the anti-oxidant additive is between 0.04 and 0.4 wt %.

5. The formulation according to claim 1, wherein the copper passivator is a compound according to formula (II) or a substituted or unsubstituted benzotriazole compound represented by the formula (III)

(II)

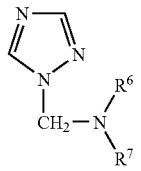

(III)

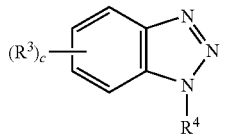

wherein R4 may be hydrogen or a group represented by the formula (IV)

(IV)

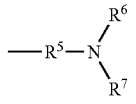

or by the formula (V)

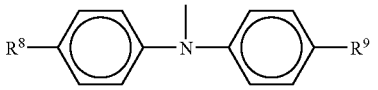

(V)

wherein:

c is 0, 1, 2 or 3;

$R^3$ is a straight or branched $C_{1-4}$ alkyl group; $R^5$ is a methylene or ethylene group; $R^6$ and $R^7$ are hydrogen or the same or different straight or branched alkyl groups of 1-18carbon atoms; $R^8$ and $R^9$ are the same or different alkyl groups of 3-15 carbon atoms.

6. The formulation according to claim 5, wherein $R^3$ is methyl or ethyl and c is 1 or 2.

7. The formulation according to claim 1, wherein between 10 mg/kg and 0.3 wt % of a di-t-butylated hydroxotoluene anti-oxidant additive is present.

8. The formulation according to claim 1, comprising between 1 and 1000 mg/kg of a sulphur or phosphorus containing additive.

9. The formulation according to claim 8, wherein the sulphur containing additive is represented by the formula $$R^1—(S)_a—R^2$$

wherein:

a is 2, 3, 4 or 5; $R^1$ and $R^2$ may be the same or different and each may be straight or branched alkyl group of 1 to 22 carbon atoms, aryl groups of 6-20 carbon atoms, alkylaryl groups of 7-20 carbon atoms or arylalkyl groups of 7-20 carbon atoms.

10. The formulation according to claim 9, wherein the content of the organic polysulfide is between 50 and 800 mg/kg.

11. The formulation according to claim 1, wherein the formulation has a sulphur content of below 4 wt %.

12. A process to prepare an electrical oil formulation according to claim 1, wherein the base oil component is subjected to a clay treatment and wherein the anti-oxidant additive is added after performing the clay treatment.

13. A process according to claim 12, wherein a copper passivator is added after performing the clay treatment.

* * * * *